United States Patent [19]

Greener

[11] Patent Number: 4,535,001

[45] Date of Patent: Aug. 13, 1985

[54] REFRACTORY PLASTIC GUNNING

[75] Inventor: Brian H. Greener, Burlington, Canada

[73] Assignee: Plibrico Limited, Burlington, Canada

[21] Appl. No.: 614,699

[22] Filed: May 29, 1984

Related U.S. Application Data

[63] Continuation of Ser. No. 436,791, Oct. 26, 1982, abandoned.

[51] Int. Cl.[3] ..... B05D 1/12

[52] U.S. Cl. ..... 427/180; 427/236; 427/421; 427/427; 118/608

[58] Field of Search ..... 427/427, 236, 426, 421, 427/180; 118/308, 317, 608; 239/650, 654

[56] References Cited

U.S. PATENT DOCUMENTS

| | | | |
|---|---|---|---|
| 3,093,497 | 6/1963 | Demaison | 427/427 |
| 3,542,250 | 11/1970 | McRitchie | 239/654 |
| 3,580,218 | 5/1971 | Grundschober et al. | 118/608 |
| 3,730,763 | 5/1973 | Schlottman et al. | 427/427 |
| 3,760,933 | 9/1973 | Maldeis et al. | 427/426 X |

*Primary Examiner*—Shrive P. Beck

*Attorney, Agent, or Firm*—Fetherstonhaugh & Co.

[57] ABSTRACT

A method of forming a refractory liner comprises the steps of granulating a plastic refractory material and immediately thereafter pneumatically gunning the granulated refractory material onto a job site without the addition of water. An apparatus for gunning a refractory material comprises a granulator, a pneumatic gunning pump and a nozzle. The granulator communicates directly with the pnuematic pump so that granulated plastic refractory material can be pumped and gunned immediately after it is granulated without the addition of water.

1 Claim, 1 Drawing Figure

REFRACTORY PLASTIC GUNNING

Figure 1:
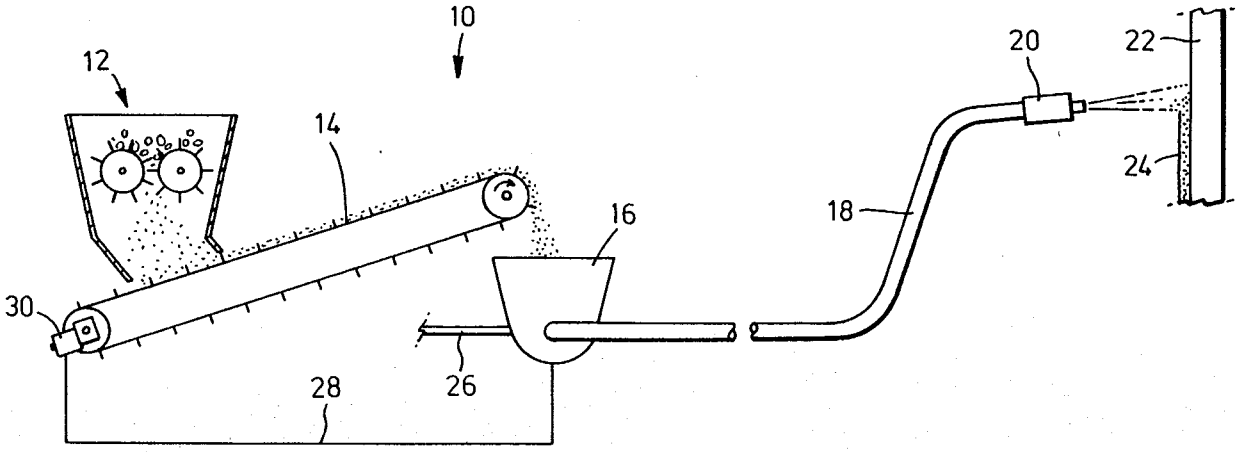

This application is a continuation, of application Ser. No. 436,791, filed 10/26/82 now abandoned.

FIELD OF INVENTION

This invention relates to the installation of plastic or mouldable specialty refractories by pneumatic application.

PRIOR ART

Plastic or mouldable refractories are a mixture of aggregates and binders in a soft moist pliable form which upon heating form a hard fire resistant mass without the numerous joints found with brick shapes. It is manufactured in a granular form which is packaged in bags or in a pliable slug form packaged in boxes.

Monolithic refractories in plastic or mouldable forms have traditionally been installed by kneading slabs or a granular form together with hammers. These have been hand wielded or more recently, with pneumatic types to ram and knit the slabs or granular consistency material together to form a monolithic mass. They also can be vibrated into metallic forms by means of high frequency vibrations. The ramming of plastics is labour intensive, subject to laminations and voids, while the vibration technique requires expensive metallic forms.

Previous attempts to pneumatically gun plastics have been specially formulated granular types. In a granulated form, depending on the method of shipment and distance, problems are encountered with compaction. A granulated refractory when compacted cannot be gunned with conventional equipment as it forms a pliable mass similar to the plastic or mouldables. Another problem encountered with granular types was the short shelf life because of the evaporation of the moisture from the exposed grains or the premature setting of the binder. Conventional plastic refractories are manufactured with sufficient moisture content to make the clays adhesive and workable.

It is well known that gunning methods of applying refractories permit a more rapid application of a refractory material to a job site than can be obtained by conventional ramming methods. The practice in gunning refractory material is to emply as a starting material a dry granular refractory material which can be easily pneumatically pumped and to mix this dry granular material with water in the gunning nozzle immediately prior to gunning. The amount of moisture in the applied refractory material is dependent upon the skill of the nozzle man as well as the amount of rebound and internal laminations. The water being added at the nozzle just prior to the installation of the refractory is a variable which is a factor in the service life of the insulation. Plastics with controlled moisture added during manufacture and installed with rammers is not subjected to rebound and laminations as with granular gunning mixes.

I have found that conventional plastic refractory materials can be gunned without the need to add water or to modify the composition of the refractory. This has been achieved by granulating the plastic refractory material and immediately thereafter pneumatically gunning the granulated refractory material onto the job site.

This innovative installation technique allows the placement of regular plastics pneumatically expeditiously with less possibility of laminations or voids and with more intimate contact of the refractory and anchorage system than is possible with the current ramming system used.

SUMMARY OF THE INVENTION

According to one aspect of the present invention there is provided a method of forming a refractory lining at a job site comprising the steps of granulating a plastic refractory material and immediately thereafter pneumatically gunning the granulated refractory material onto the job site without the need to add water at the discharge nozzle.

According to a further aspect of the present invention there is provided an apparatus for gunning the refractory material which comprises a granulator for receiving a conventional plastic refractory material and granulating it and discharging it in a granular form, a pneumatic gunning pump communicating directly with the granulator for receiving the granulated material and a nozzle communicating directly with the pneumatic pump whereby granular material may be pumped through the nozzle onto a job site.

PREFERRED EMBODIMENT

The invention will be more clearly understood after reference to the following detailed specification read in conjunction with the drawings wherein FIG. 1 is a diagrammatic illustration of an apparatus suitable for gunning refractory material according to the method of the present invention.

With reference to FIG. 1 of the drawings the reference numeral 10 refers generally to an apparatus for gunning a plastics refractory material. The apparatus comprises a granulator 12 for discharging granular plastics material onto a conveyor 14. The conveyor 14 conveys the granulated material directly to a pump 16. The pump 16 is connected by means of a conduit 18 to a gunning nozzle 20. The gunning nozzle 20 is used to discharge the stream of granular plastics material onto a job site 22 to form a layer of plastics refractory material 24 on the surface of the job site 22.

The motor 30 of the conveyor 14 is connected through a feedback line 28 to the pneumatic gunning pump so that the conveyor operates to discharge granular material into the pump 16 as acquired in use.

The granulator 12 may be of a conventional construction in which rotors which are formed with granulating blades serve to granulate plastic refractory material to a particle size no greater than 8 mm in diameter.

The conveyor 14 serves to place the granulator 12 in communication with the pump 16 and may be used to meter the flow of granular material to the pump 16 in accordance with the demand at the nozzle. The pump 16 may be a conventional Reed gun which receives compressed air from a suitable source through an air inlet conduit 26. The compressed air acts as a carrier for conveying the granular plastic material through the conduit 18 to the nozzle 20. The nozzle 20 is manually engageable to direct the discharge stream of granular material onto the work site. The nozzle 20 may be of a conventional construction of the type used for gunning dry particulate material however the present method permits gunning without the addition of water to the granular plastic refractory at the gunning nozzle.

The method of the present invention is suitable for use in gunning refractory material to form linings in furnaces, soaking pits, metalurgical vessels, pig iron ladles and the like. One or more layers of refractory material may be gunned onto the surface of the work site as required in use. Because of the lower moisture content of the final coating the preliminary firing of the furnace can be achieved with a greatly reduced risk of damage to the refractory.

In use, conventional plastic refractory material is loaded into the granulator and granulated to form granules which are preferably of a size no greater than 8 mm in diameter. The granulated particles are conveyed to the pump 16 with the dwell time between granulating and pumping being rarely more than minutes. By depositing the granular material onto a moving conveyor the material is not piled high upon itself with the result that it does not tend to clump under its own weight. The loosely arranged granular material is conveyed to the pump 16 wherein it is brought into contact with the pressurized air which serves to entrain the particles in an air stream and thereby retain them in a fluid condition as they pass through the conduit 18 and the nozzle 22.

Plastic refractory materials which have been successfully gunned by the method of the present invention include the following

| PRODUCT T.M. Identification. | WATER RANGE % BY WEIGHT |
|---|---|
| Plibrico Super F AB | 5.4–9.3 |
| Plibrico Black Spot | about 11.1 |
| Plibrico 80 AB | 7.1–9.2 |
| Plibrico L936 | 14.4–16.0 |
| Plibrico 68 S | 7.5 |
| Plibrico 80 S | about 4–7.3 |

From the foregoing it will be apparent that the apparatus of the present invention is a simple assembly of components which are readily available to those engaged in the installation of refractory linings. In addition, it will be apparent that the method of the present invention is a simple and efficient method which permits the use of conventional refractory plastics material as a gunning medium. As a result of this method it is only necessary for the user of a refractory material to stock plastic refractory material as the present method permits convention plastic refractory material commonly used in casting and ramming processes to be used in a gunning method of forming a refractory lining. Thus, the user is able to reduce his inventory by eliminating dry granular refractory material from his inventory.

These and other advantages of the method and apparatus of the present invention will be apparent to those skilled in the art.

I claim:

1. A method of forming a refractory lining on a surface at a job site comprising the steps of;

granulating by means of a granulator at said job site a plastic refractory material having a moisture content in the range of 4% to 16% by weight to provide loosely arranged granular refractory material said granulator directly communicating with a pneumatic gunning pump and immediately after granulating pneumatically gunning the loosely arranged granulated refractory material onto the surface without adding water at the discharge nozzle.

* * * * *